US009108337B2

(12) United States Patent
Blaha

(10) Patent No.: US 9,108,337 B2
(45) Date of Patent: Aug. 18, 2015

(54) SUPERIOR SKID SPLITTER SYSTEMS

(76) Inventor: James Blaha, Howell, MI (US)

( * ) Notice: Subject to any disclaimer, the term of this patent is extended or adjusted under 35 U.S.C. 154(b) by 933 days.

(21) Appl. No.: 13/305,370

(22) Filed: Nov. 28, 2011

(65) Prior Publication Data

US 2012/0132320 A1 May 31, 2012

Related U.S. Application Data

(60) Provisional application No. 61/417,557, filed on Nov. 29, 2010.

(51) Int. Cl.
*B27L 7/06* (2006.01)
*B27L 7/00* (2006.01)

(52) U.S. Cl.
CPC .... *B27L 7/06* (2013.01); *B27L 7/00* (2013.01)

(58) Field of Classification Search
CPC ..... B27L 7/00; B27L 7/06; B27L 7/08
USPC ..... 83/870, 874
See application file for complete search history.

(56) References Cited

U.S. PATENT DOCUMENTS

| | | | | |
|---|---|---|---|---|
| 4,337,809 | A | 7/1982 | Bertolette et al. | |
| 4,353,401 | A * | 10/1982 | Schilling | 144/195.1 |
| 4,426,782 | A * | 1/1984 | Baisden | 30/379.5 |
| 4,432,402 | A * | 2/1984 | Wirsbinski | 144/195.1 |
| 4,520,854 | A * | 6/1985 | May | 144/195.1 |
| 4,596,279 | A | 6/1986 | Taylor | |
| 4,860,806 | A * | 8/1989 | Brace | 144/195.8 |
| 5,337,810 | A | 8/1994 | McCormack | |
| 6,640,852 | B1 | 11/2003 | Rogers | |
| 7,255,143 | B1 | 8/2007 | Babcock et al. | |
| 2008/0271817 | A1 * | 11/2008 | Priebe | 144/195.1 |

* cited by examiner

*Primary Examiner* — Shelley Self
*Assistant Examiner* — Matthew G Katcoff
(74) *Attorney, Agent, or Firm* — RG Patent Consulting, LLC; Rachel Gilboy

(57) ABSTRACT

Superior Skid Splitter is designed to lift, split, and load firewood logs, effectively eliminating the need for physical labor when handling and processing the wood. The device features an adjustable, hydraulic wood splitter containing a plate assembly with a six-way cutter head on its underside. The unit can be attached to a skid loader or a tractor, allowing it to lift a single large log and split it into six smaller pieces. It can also be designed to grab and carry long lengths of logs to load onto trucks or trailers, and may load pieces of split wood into receptacles because of its relative orientation.

15 Claims, 5 Drawing Sheets

SUPERIOR SKID SPLITTER SYSTEMS

CROSS-REFERENCE TO RELATED APPLICATION

The present application is related to and claims priority from prior provisional application Ser. No. 61/417,557, filed Nov. 29, 2010 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

FIELD OF THE INVENTION

The present invention relates generally to the field of log splitters and more specifically relates to skid splitter systems.

DESCRIPTION OF THE RELATED ART

Many individuals burn firewood as fuel to heat their homes and out-buildings and for recreational purposes. Often individuals in remote areas may cut timber with the permission of the landowner. Firewood may be sold in small packages to urban dwellers; however this firewood is typically very expensive and is not financially practical to be used on a volume basis. Chain saws and axes may be used to fall the trees to be cut up for tinder. Most firewood also requires splitting, which also allows for faster seasoning by exposing more surface area. Splitting firewood can be accomplished using a splitting maul, a heavy, long-handled hammer used for splitting a piece of wood along its grain. One side of its head is like a sledgehammer, and the other side is like an axe. Splitting firewood in this fashion, in this way, is impractical for large amounts of firewood as it is an extremely time-consuming and labor-intensive process. Individuals may be required to lift large, heavy logs, split the logs, and then physically transport the resulting pieces to the appropriate receptacles or vehicles.

Manual log splitters, which use mechanical leverage to force logs through a sharpened blade assembly and screw or 'corkscrew' types that are driven directly from an agricultural tractor's power take-off shaft where the splitter is mounted on the three point linkage may also be used. These wood splitters are designed to alleviate some of the labor from the process but may be dangerous in use. Traditional log splitters may mount hydraulic cylinders from end to end which tends to make the splitter long and nose-heavy thereby reducing lifting capacity and relative stability. Further, present options may be only capable of splitting wood, without aiding in the other parts of the process. These devices may also prove inefficient.

Various attempts have been made to solve the above-mentioned problems such as those found in U.S. Pat. Nos. 5,337,810; 4,353,401; 7,255,143; 4,596,279; 6,640,852; and 4,337,809. This art is representative of log splitting means. None of the above inventions and patents, taken either singly or in combination, is seen to describe the invention as claimed.

Ideally, a skid splitter system should be safe, user-friendly and, yet would operate reliably and be manufactured at a modest expense. Thus, a need exists for a reliable skid splitter system to avoid the above-mentioned problems.

BRIEF SUMMARY OF THE INVENTION

In view of the foregoing disadvantages inherent in the known log splitting art, the present invention provides a novel skid splitter system. The general purpose of the present invention, which will be described subsequently in greater detail is to provide the ability to lift, split, and load firewood logs, effectively eliminating the need for physical labor using a multi-purpose machine. This device features an adjustable, hydraulic wood splitter containing a plate assembly preferably with a six-way cutter head on its underside. The unit can be attached to a skid loader, a tractor or other host drive-machine, allowing it to lift a single large log and split it into six smaller pieces. It can also be designed to grab and carry long lengths of logs to load onto trucks or trailers, and may load pieces of split wood into receptacles because of its relative orientation. Traditional log splitters as mentioned previously may mount hydraulic cylinders from end to end which tends to make the splitter long and nose-heavy thereby reducing lifting capacity and relative stability, whereas the present invention has the hydraulic cylinder located above the frame assembly reducing the overall length by about 30% and yet providing the same stroke. This feature improves weight distribution and safety in use.

A skid splitter system is disclosed herein in a preferred embodiment preferably comprising: a frame assembly including: an attachment plate; a post; a hydraulic cylinder; and a log push plate assembly. The log push plate assembly including: a log push plate; a gussetted slider-tube; and a splitting wedge assembly. The post is perpendicularly attached to the attachment plate, the gussetted slider-tube and splitting wedge assembly opposing each other. The attachment plate has a profile conforming to a host drive-machine. As such, the attachment plate is attachable to the host drive-machine such that the skid splitter system is made operable by the host drive-machine actuating the hydraulic cylinder to operate the system. The host drive-machine comprises a hydraulic fluid reservoir and a pump to activate said hydraulic cylinder (via hydraulic levers or other), and the skid splitter system is horizontally oriented outwardly from the host drive-machine.

The skid splitter system is preferably mounted from the host drive-machine (as attached from the front or rear in preferred embodiments) such that the hydraulic cylinder is located above the post allowing the splitting wedge assembly and the log push plate on the gussetted slider-tube to be normally-downwardly-facing so that the log push plate and splitting wedge assembly are able to clamp one to each end of the log such that the log may be squeeze-held, lifted, six-way split and dropped into a receptacle. The skid splitter system is usable to lift the log, split the log into six pieces and load the log. The log may be split into more or less than six pieces if removable wings are added or removed. Splitting versatility is provided such that the logs may be 2-way split, 4-way split, and/or 6-way split by addition/removal of the removable wings.

The gussetted slider-tube is preferably coupled to the log push plate; the gussetted slider-tube is preferably located circumferentially about the post (post may be square/rectangular or round tubing and the gussetted slider-tube having a matching profile, only slightly larger such that it fits about the post without causing excessive friction.) The post determines a defined travel path for the log push plate to travel thereon. In preferred embodiments a set of four nylon/plastic slide blocks are positioned between the post and the gussetted slider-tube to effectively prevent metal to metal contact to reduce wear of the post and the gussetted slider-tube, thereby promoting longevity of the present invention. The post may be a tube comprising dimensions of about 6 inches diameter by about 6 feet long.

The splitting wedge assembly comprises a progressive step wedge; a six-way-splitting-wedge; the six-way-splitting-wedge assembly comprising removable wings for added splitting versatility of the logs (into more or less pieces.) The removable wings may be fastened via bolts or other suitable fastening means to the six-way-splitting-wedge (with holes located therein) and may be oriented to suit the desired splitting orientation. The log push plate preferably comprises a through opening such that the progressive step wedge is able to pass through the through opening. The gussetted slider-tube is removably coupled to the hydraulic cylinder via at least one pin, making it also adjustable. The splitting wedge assembly comprises a left-side jaw and the log push plate comprises a right-side jaw; the left- and right-side jaws are movable in relation to each other (together and apart from) enabling the skid splitter system to pick up log(s) from above and release a six-way split log into a receptacle from above (as processed firewood for use.)

The hydraulic cylinder is connected to the host drive-machine via hydraulic hoses wherein the hydraulic hoses are in fluid communication with the hydraulic fluid reservoir such that the pump is able to circulate fluid to and from the hydraulic cylinder to open and close the right-side and left-side jaws. Preferably the hydraulic hoses are located above the hydraulic cylinder such that the hydraulic hoses are located separate and apart from the log to avoid being pinched by the logs, or jaws. In this way the present invention is safer in use and requires less maintenance (fixing of hoses and other.) The hydraulic cylinder is able to be remotely operated in the present embodiment via hydraulic levers on the host machine or via a remote control, as mentioned previously. This feature enables the operator to be a safe distance away while the wood is being processed.

The post provides a mount for the splitting wedge assembly such that the log push plate assembly can be moved via the hydraulic cylinder, when actuated, the hydraulic cylinder pushing (or pulling) the log push plate and the gussetted slider-tube as the log push plate assembly towards (or away from) the splitting wedge assembly such that a log located therebetween is able to be control-fractured. The progressive step wedge in preferred embodiments is able to minimize the force needed to split the log by providing a smaller surface-area blade to contact upon the log and push through it followed by the six-way splitter. The requirement of less force being needed makes the device safer in use and requires less input power thereby conserving fuel and minimizing wear-and-tear on the system.

A method of using a skid splitter system is also disclosed herein preferably comprising the steps of: picking a log up (squeezing on the two ends of the log from the top) from above via a splitting wedge assembly and a log push plate assembly of the skid splitter system; splitting the log into six (more or less) pieces of split firewood via hydraulic power provided by a host drive-machine; and releasing the split firewood into a receptacle (or truck box or the like.)

The present invention holds significant improvements and serves as a skid splitter system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, superior skid splitter system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a firewood splitting device and more particularly to a skid splitter system, entitled 'Superior Skid Splitter', as used to improve the convenience, efficiency and safety of wood splitting processes.

Generally speaking, Superior Skid Splitter is designed to effectively eliminate the manual labor traditionally necessary for splitting logs. The invention may comprise a steel attachment plate containing a tube measuring approximately 6" by 6', which can protrude straight out from the plate. A tube preferably measuring eight square inches can slide over the smaller tube, and a log pusher plate can be attached to the underside of the larger tube. A hydraulic cylinder (about 5" by 30") may be mounted adjacent to the top side of the 8" tube, in order to supply movement and force-transfer to the pusher plate. A set of four nylon/plastic slide blocks can be positioned between the 8" tube and the 6" tube to act as the wear points of the unit, and to virtually eliminate any metal to metal contact. On the opposite end of the 6" tube, on its underside, may be a six-way splitter blade containing removable (and movable) wings for added splitting versatility. The unique design and position of the hydraulic cylinder may reduce the risk of damage to components and may allow the device to realize approximately twice the stroke length and half the overall length.

Figure 1:
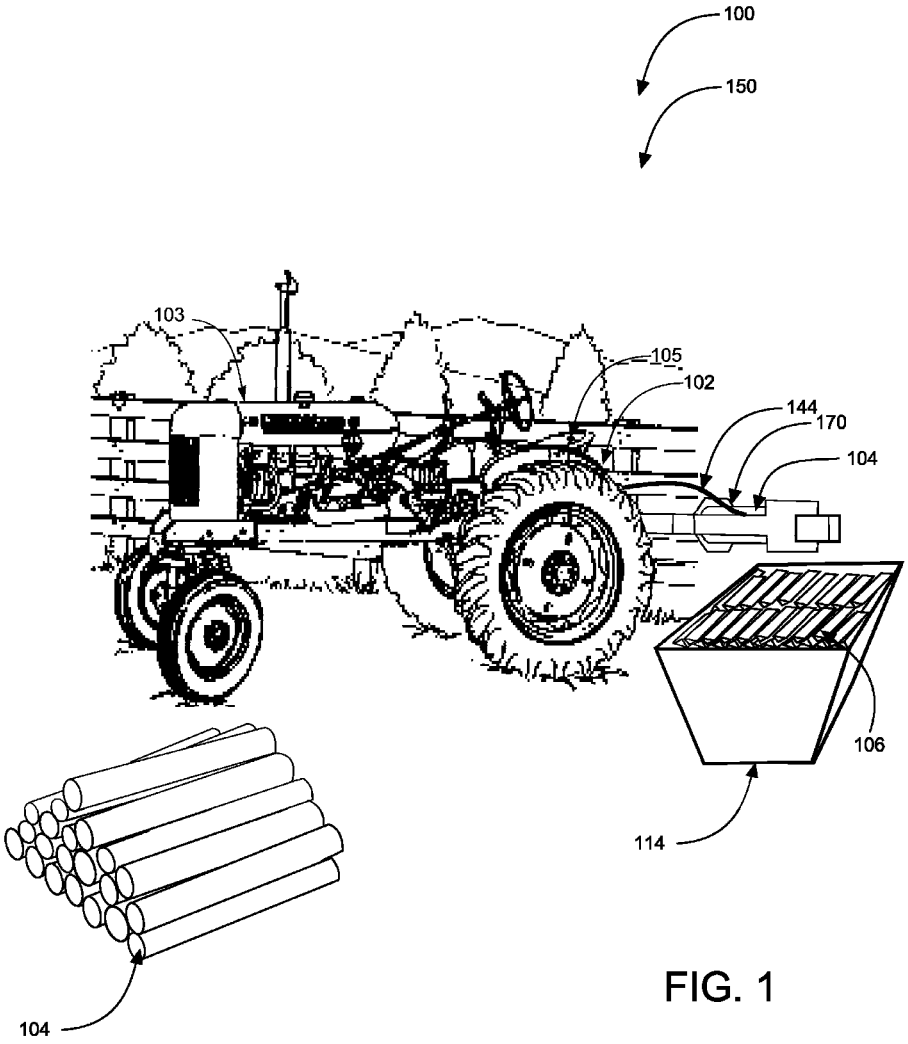
FIG. 1 shows a perspective view illustrating a skid splitter system in an in-use condition according to an embodiment of the present invention.

Referring to the drawings by numerals of reference there is shown in FIG. 1, skid splitter system 100 in in-use condition 150 according to an embodiment of the present invention.

Skid splitter system 100 preferably comprises: frame assembly 110 including: attachment plate 120; and post 130. Skid splitter system 100 also preferably comprises hydraulic cylinder 140; log push plate assembly 160 (log push plate assembly 160 including log push plate 170; and gussetted slider-tube 180); and splitting wedge assembly 190.

Referring now to attachment plate 120 which is attachable to at least one host drive-machine 102 (physically fastened and in fluid communication with) such that skid splitter system 100 is made operable by host drive-machine 102. Actuation of hydraulic cylinder 140 may occur via hydraulic levers 105 on tractor 103 for example (as shown.) Other means of actuation may comprise non-hydraulic means such as pneumatic, electric or the like and will still be considered within the scope of the present invention. Attachment plate 120 preferably comprises ferrous material such that it is suitably durable, providing longevity for the present invention. Tractor 103 provides that the present invention is suitably portable for use at various locations. The present invention may be front-mounted (preferred), rear-mounted (as shown) or side-mounted in alternate embodiments.

Figure 2:
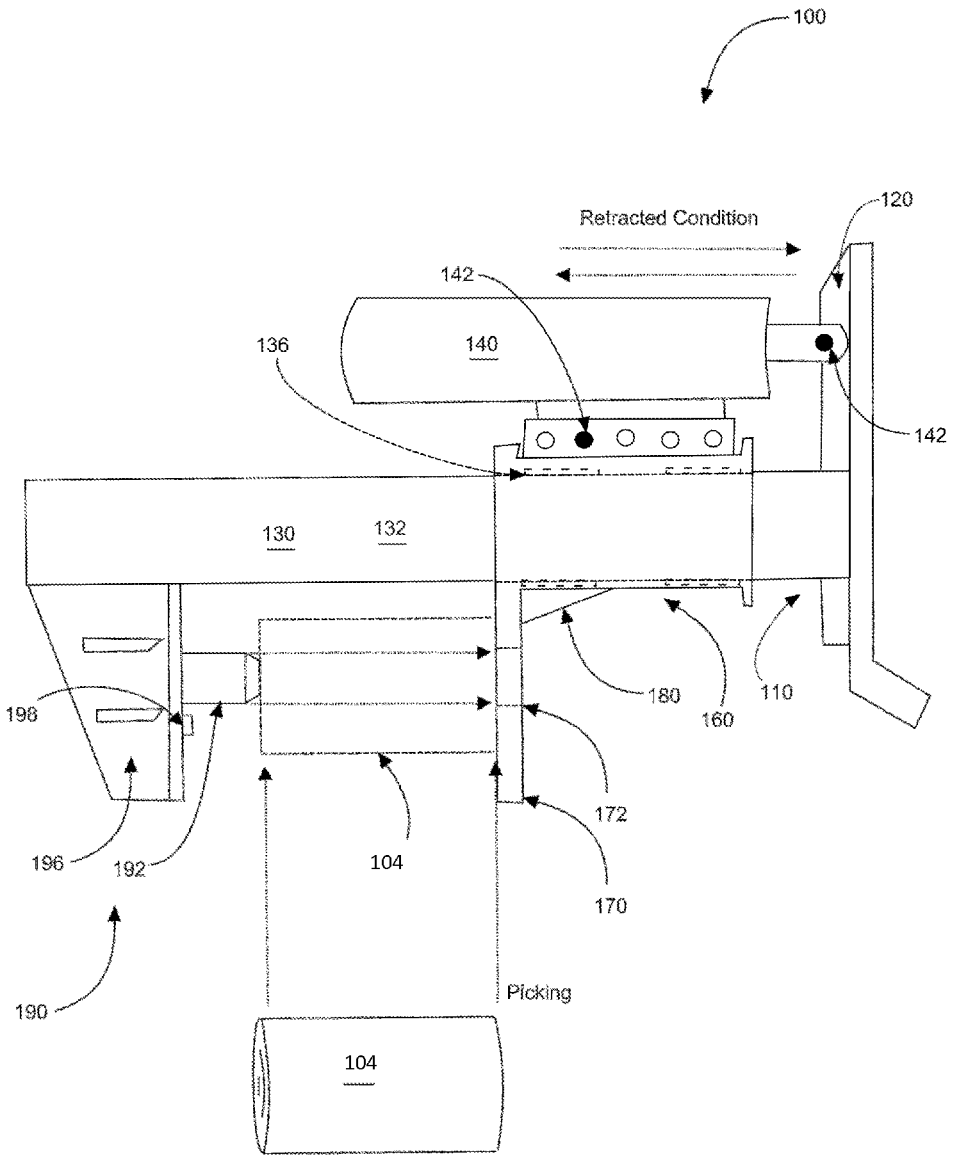
FIG. 2 is a side perspective view illustrating the skid splitter system (as retracted) according to an embodiment of the present invention of FIG. 1.
Figures 3A, 3B:
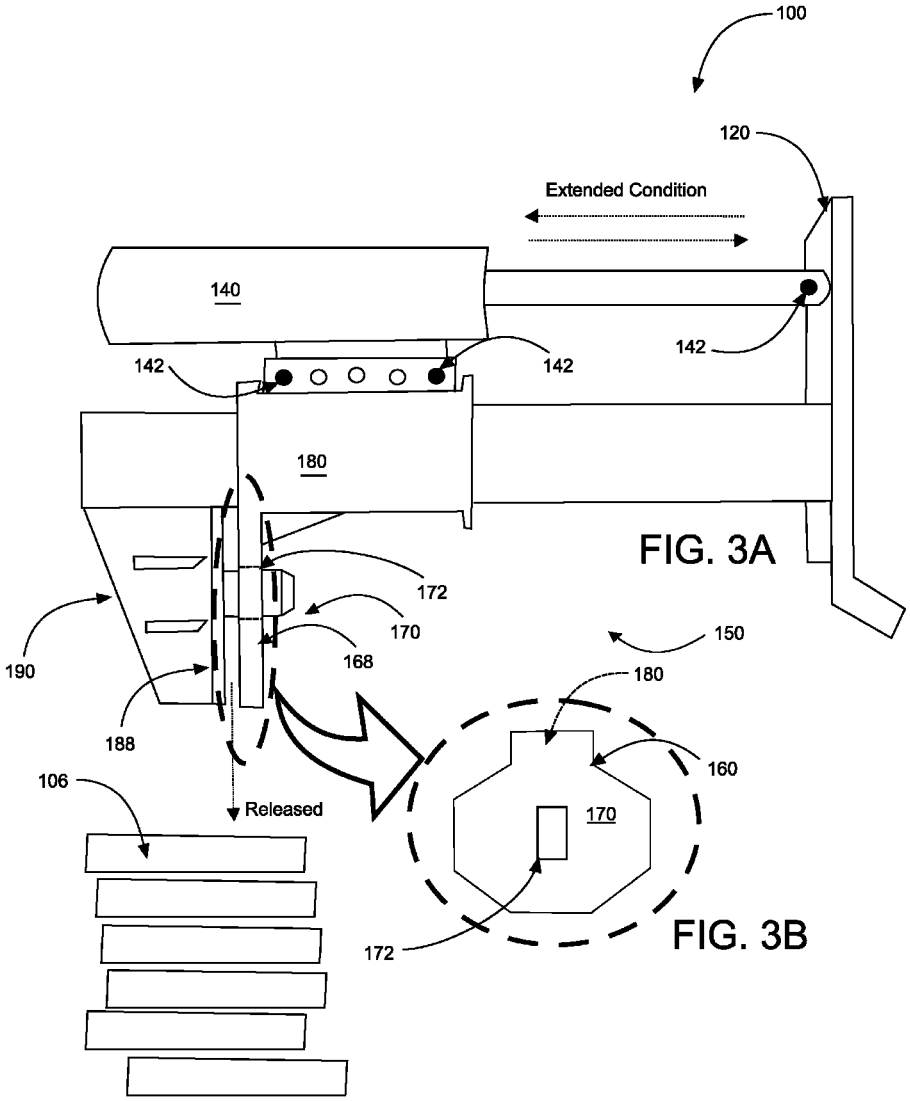
FIG. 3A is another side perspective view illustrating the skid splitter system (as extended) according to an embodiment of the present invention of FIGS. 1 and 2.
FIG. 3B is a top view illustrating a log push plate of the skid splitter system according to an embodiment of the present invention of FIGS. 1 and 3A.
Figure 4:
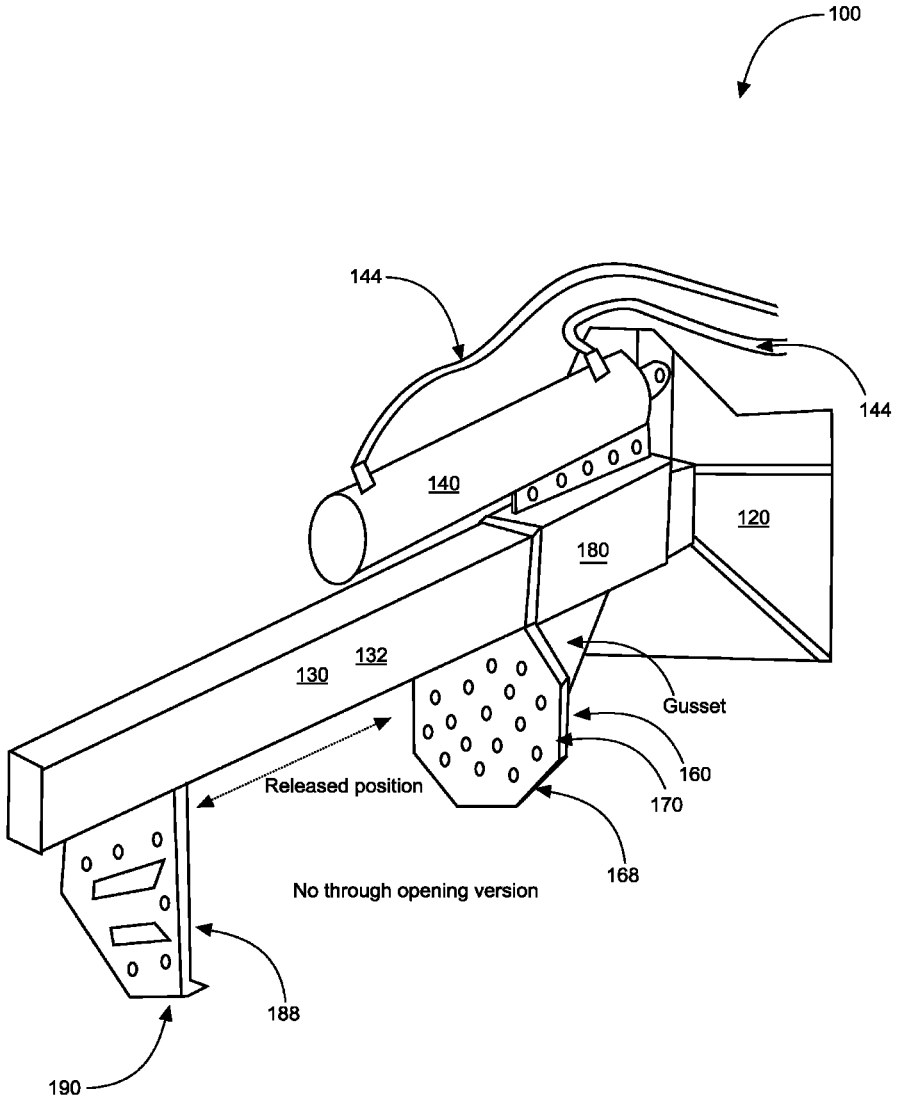
FIG. 4 is yet another perspective view illustrating the skid splitter system according to an embodiment of the present invention of FIG. 1.

Gussetted slider-tube 180 is preferably coupled to log push plate 170 via welding or may be integral in other embodiments. At least one gusset is preferably used to 'gusset-strengthen', to prevent stress bending moments and to substantially ensure the tolerance between post 130 and log push plate assembly 160 is maintained for ease of movement along post 130. Gussetted slider-tube 180 is located circumferentially about post 130, as shown and runs parallel to post 130 during travel. Post 130 determines a defined travel path for log push plate 170 to travel thereon. Log push plate 170 is oriented perpendicularly to log push plate assembly 160 and post 130. Log push plate 170 comprises a suitable substantially planar surface area to hold log 104 during use (picking, holding and splitting.) Log push plate 170 may comprise a gripping surface in other embodiments such that log 104 may be gripped. It should be appreciated that gussetted slider-tube 180 may comprise rectangular tubing as shown in FIG. 4 or round tubing as shown in FIGS. 2 and 3A.

Skid splitter system 100 is preferably horizontally oriented outwardly from host drive-machine 102, as shown in FIG. 1 or may be attached via a universal quick attacher (such as for example quick attach as manufactured by TACH-ALL™) or the like by removing the bucket. Skid splitter system 100 may also be oriented vertically or other orientation to fit the application and available work space. Host drive-machine 102 may manipulate the present invention to different heights for example by lifting the bucket arms attached to the universal quick attacher for picking, splitting or releasing operations.

Post 130 also provides a mount for splitting wedge assembly 190 such that log push plate assembly 160 can be moved via hydraulic cylinder 140. When actuated, hydraulic cylinder 140 pushes as in FIG. 3A (or pulls when retracting—as in FIG. 2) log push plate 170 of gussetted slider-tube 180 and log push plate assembly 160 towards (or away from) splitting wedge assembly 190 such that at least one log 104 located therebetween is able to be control-fractured (or released.) The reader is able to distinguish between extension (extended) and retraction (retracted) conditions as illustrated in FIGS. 3A and 2, respectively. In this way skid splitter system 100 is usable to lift log 104, split log 104 into six pieces (of split firewood 106) and load log 104 (as split firewood 106). Log 104 when processed comprises split firewood 106.

Host drive-machine 102 comprises a skid loader (not shown) with a hydraulic fluid reservoir and a pump to activate hydraulic cylinder 140 wherein skid splitter system 100 is horizontally mounted adjacent and in contact with the skid loader or a tractor 103, as shown.

Referring now to FIG. 2, showing skid splitter system 100 (as retracted) according to an embodiment of the present invention of FIG. 1.

Splitting wedge assembly 190 comprises a progressive step wedge 192 in preferred embodiments. Splitting wedge assembly 190 also comprises six-way-splitting-wedge 196 in preferred embodiments such that log 104 may be processed into split firewood 106 in a form that is easy to use for handling, storing and ultimately burning. Additionally, using six-way-splitting-wedge 196 minimizes the number of times that log 104 needs to be processed before being altered into split firewood 106.

Post 130 may be a tube 132 comprising dimensions of about 6 inches diameter (in round tubes) by about 6 feet long. Tube 132 preferably comprises dimensions of about 6 inch by 6 inch square tube (heavy wall or light wall depending on service requirements.) Tube 132 may comprise rectangular or round tubing, as previously mentioned. In preferred embodiments a set of four nylon/plastic slide blocks 136 may be positioned between tube 132 and gussetted slider-tube 180 to prevent metal to metal contact thus reducing wear of tube 132 and gussetted slider-tube 180. Nylon/plastic slide blocks 136 are replaceable and may be sacrificial to increase longevity of the present invention. Six-way-splitting-wedge 196 may also comprise removable wings 198 for added splitting versatility in certain embodiments. Removable wings 198 may be bolted through six-way-splitting-wedge 196, allowing removable wings 198 to be set at different orientations and be setup as a two-way, four-way, or six-way splitter design, depending on the user's preference as to how he/she wants logs 104 processed. Removable wings 198 allow logs 104 to be split into different sizes and profiles.

Referring now to FIGS. 3A and 3B; FIG. 3A showing another side perspective view illustrating skid splitter system 100 (as extended) according to an embodiment of the present invention of FIGS. 1 and 2; and FIG. 3B showing a top view illustrating log push plate 170 of skid splitter system 100 according to an embodiment of the present invention of FIGS. 1 and 3A.

Log push plate 170 may comprise a through opening 172 (through opening 172 shown in FIGS. 1-3B, but without through opening 172 in FIG. 4) such that progressive step wedge 192 is able to pass through through opening 172. Through opening 172 comprises a slightly larger opening than progressive step wedge 192 such that friction doesn't occur, especially important when metal has expanded during heat of use or during hot days and is such that progressive step wedge 192 is able to travel through an entire stroke. Through opening 172 and progressive step wedge 192 comprise a similar mated shaped, wherein one matches to the other, as shown in FIG. 3A. Progressive step wedge 192 comprises a smaller protruding wedge to contact log 104 first creating a small surface area crack (crack initiation means) and is then followed by six-way-splitting-wedge 196 delivering the final splitting action, thus requiring less 'brute force' and thus smaller cylinders, pumps and the like may be used, thereby increasing efficiency.

Gussetted slider-tube 180 may be removably coupled to hydraulic cylinder 140 via at least one pin 142 and hydraulic cylinder 140 is also preferably connected to attachment plate 120 via another of pin 142. In this way hydraulic cylinder 140 can be adjusted for stroke length as determined by the relative length of log(s) 104. Hydraulic cylinder 140 is able to be remotely operated. Hydraulic cylinder 140 may comprise different sizes and shapes (length of stroke, different size bore, different profile, angles may be altered, and the like.)

Referring now to FIG. 4, yet another perspective view illustrating skid splitter system 100 according to an embodiment of the present invention of FIG. 1.

Skid splitter system 100 is mounted from host drive-machine 102 such that hydraulic cylinder 140 is located above post 130 allowing splitting wedge assembly 190 and log push plate 170 on gussetted slider-tube 180 to be normally-downwardly-facing so that log push plate 170 and splitting wedge assembly 190 are able to clamp one to each end of log 104 such that log 104 may be squeeze-held and lifted, as indicated in FIG. 2. In this way the present invention is suitably oriented for convenient use when picking and releasing.

Skid splitter system 100 is mounted from host drive-machine 102 such that hydraulic cylinder 140 is located above post 130 allowing splitting wedge assembly 190 and log push plate 170 on gussetted slider-tube 180 to be normally-downwardly-facing (as also described previously) such that log push plate 170 and splitting wedge assembly 190 are able to clamp one to each end of log 104 such that log 104 may be squeeze-held and six-way split and dropped into receptacle 114, shown in FIG. 1. Log(s) 104 may be loaded in a similar manner into a vehicle box of a pickup truck for example or a trailer for transport to a residence for use or for sale to others. The present invention when used properly is designed to decrease handling time, such that greater cost-efficiency is realized.

Splitting wedge assembly 190 comprises left-side jaw 188 and log push plate 170 comprises right-side jaw 168; left-side jaw 188 and right-side jaw 168 are movable in relation to and from each other enabling skid splitter system 100 to pick up log(s) 104 (from above) and release six-way split log 104 into receptacle 114 from above, as shown in FIG. 1.

Hydraulic cylinder 140 is preferably connected to host drive-machine 102 via hydraulic hoses 144; wherein hydraulic hoses 144 are in fluid communication with hydraulic fluid reservoir such that the pump is able to circulate fluid to hydraulic cylinder 140 (via hydraulic hoses 144) to open and close right-side jaw and left-side jaw 168 and 188, respectively. Hydraulic hoses 144 are preferably located above hydraulic cylinder 140 such that hydraulic hoses 144 are located apart (a distance from—not proximate to) from log 104 and right-side jaw and left-side jaw 168 and 188, respectively, to avoid being pinched. In this way maintenance on damaged hydraulic hoses 144 is minimized. The present invention may comprise a kit of the components mentioned herein, with a set of user instructions, the kit available for manufacture and/or sale.

Figure 5:
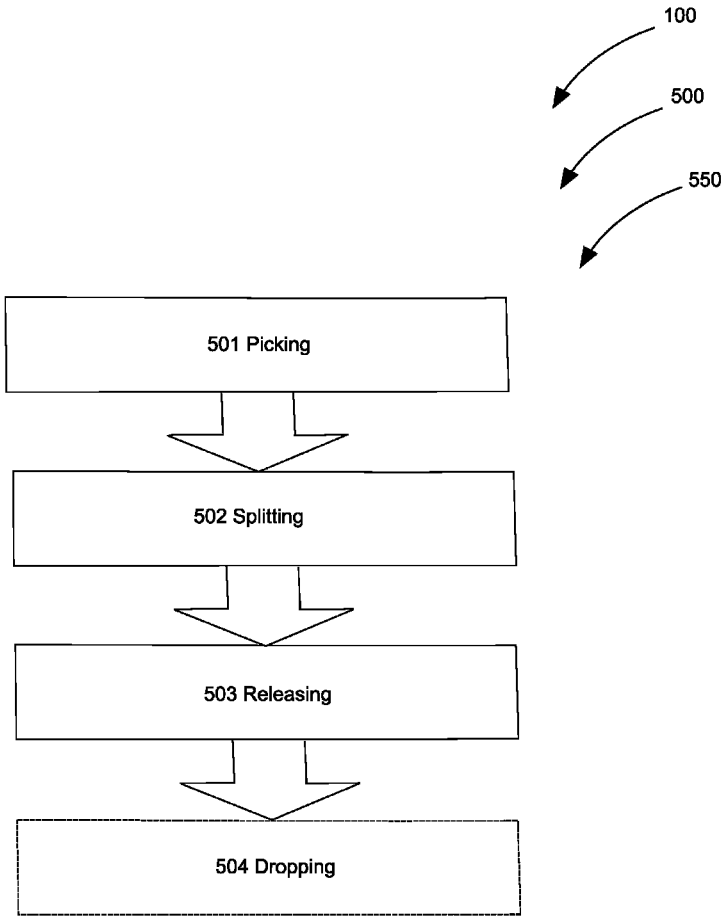
FIG. 5 is a flowchart illustrating a method of using the skid splitter system according to an embodiment of the present invention of FIGS. 1-4.

Referring now to FIG. 5, a flowchart 550 illustrating a method of using (method of use 500) skid splitter system 100 according to an embodiment of the present invention of FIGS. 1-4.

A method of using (method of use 500) skid splitter system 100 preferably comprises the steps of: step one 501 picking log 104 up; step two 502 splitting log 104 into six pieces of split firewood 106 using progressive step wedge 192; and step three 503 releasing split firewood 106. Method of use 500 may further comprise step four 504 of allowing the split firewood 106 to drop(ping) into receptacle 114 (truck bed, trailer or the like.)

It should be noted that step 504 is an optional step and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A skid splitter comprising:

a frame assembly including;
- an attachment plate;
- a post; and
- a hydraulic cylinder;

a log push plate assembly including;
- a log push plate;
- a gussetted slider-tube; and
- a splitting wedge assembly;

wherein said attachment plate is attachable to a host drive-machine such that said skid splitter is made operable by said host drive-machine actuating said hydraulic cylinder;

wherein said gussetted slider-tube is coupled to said log push plate;

wherein said gussetted slider-tube is located circumferentially about said post;

wherein said post determines a defined travel path for said log push plate to travel thereon;

wherein said skid splitter is horizontally oriented outwardly from said host drive-machine;

wherein said post provides a mount for said splitting wedge assembly such that said log push plate assembly can be moved via said hydraulic cylinder, when actuated;

wherein said hydraulic cylinder pushes said log push plate and said gussetted slider-tube and said log push plate assembly towards said splitting wedge assembly such that a log located therebetween is able to be control-fractured;

wherein said splitting wedge assembly comprises a step wedge; and wherein said log push plate comprises a through opening such that said step wedge is able to pass through said through opening.

2. The skid splitter of claim 1 wherein said splitting wedge assembly comprises a six-way-splitting-wedge.

3. The skid splitter of claim 1 wherein said post is a tube comprising dimensions of about 6 inches diameter by about 6 feet long.

4. The skid splitter of claim 3 further comprising a set of four slide blocks positioned between said tube and said gussetted slider-tube to prevent metal to metal contact to reduce wear of said tube and said gussetted slider-tube.

5. The skid splitter of claim 2 wherein said six-way-splitting-wedge comprises removable wings for added splitting versatility such that said logs may be 2-way split, 4-way split, or 6-way split by changing the number of said removable wings thereon.

6. The skid splitter of claim 1 wherein said gussetted slider-tube is removably coupled to said hydraulic cylinder via at least one pin.

7. The skid splitter of claim 1 wherein said skid splitter is usable to lift said log and split said log into six pieces.

8. The skid splitter of claim 1 wherein said host drive-machine comprises a skid loader with a hydraulic fluid reservoir and a pump to activate said hydraulic cylinder, wherein said skid splitter is horizontally mounted adjacent, and in contact with, said skid loader.

9. The skid splitter of claim 1 wherein said host drive-machine comprises a tractor with a hydraulic fluid reservoir and a pump to activate said hydraulic cylinder wherein said skid splitter is horizontally mounted adjacent and in contact with said tractor.

10. The skid splitter of claim 9 wherein said skid splitter is mounted from said host drive-machine such that said hydraulic cylinder is located above said post allowing said splitting wedge assembly and said log push plate on said gussetted slider-tube to be normally-downwardly-facing so that said log push plate and splitting wedge assembly are able to clamp one to each end of said log such that said log may be squeeze-held and lifted.

11. The skid splitter of claim 1 wherein said skid splitter is mounted from said host drive-machine such that said hydraulic cylinder is located above said post allowing said splitting wedge assembly and said log push plate on said gussetted slider-tube to be normally-downwardly-facing so that said log push plate and splitting wedge assembly are able to clamp one to each end of said log such that said log may be squeeze-held and six-way split and dropped into a receptacle.

12. The skid splitter of claim 11 wherein said splitting wedge assembly comprises a left-side jaw and said log push plate comprises a right-side jaw, said left-side jaw and said right-side jaw are movable in relation to and from each other enabling said skid splitter to pick up said log(s) from above and release six-way split said log(s) into said receptacle from above.

13. The skid splitter of claim 12 wherein said hydraulic cylinder is connected to said host drive-machine via hydraulic hoses wherein said hydraulic hoses are in fluid communication with said hydraulic fluid reservoir such that said pump is able to circulate fluid to said hydraulic cylinder to open and close said right-side jaw and said left-side jaw, wherein said hydraulic hoses are located above said hydraulic cylinder such that said hydraulic hoses are located apart from said log to avoid being pinched.

14. A skid splitter comprising:

a frame assembly including;

an attachment plate;

a post; and a hydraulic cylinder;

a log push plate assembly including;

a log push plate;

a gussetted slider-tube; and a splitting wedge assembly;

wherein said post is perpendicularly attached to said attachment plate said attachment plate having a profile conforming to a host drive-machine;

wherein said attachment plate is attachable to said host drive-machine such that said skid splitter system is made operable by said host drive-machine actuating said hydraulic cylinder;

wherein said gussetted slider-tube is coupled to said log push plate;

wherein said gussetted slider-tube is located circumferentially about said post;

wherein said post determines a defined travel path for said log push plate to travel thereon;

a set of four slide blocks positioned between said post and said gussetted slider-tube to prevent metal to metal contact to reduce wear of said post and said gussetted slider-tube;

wherein said post is a tube comprising dimensions of about 6 inches diameter by about 6 feet long;

wherein said splitting wedge assembly comprises a step wedge;

wherein said splitting wedge assembly comprises a six-way-splitting-wedge;

wherein said six-way-splitting-wedge assembly comprises removable wings for added splitting versatility of said logs;

wherein said log push plate comprises a through opening such that said step wedge is able to pass through said through opening;

wherein said gussetted slider-tube is removably coupled to said hydraulic cylinder via at least one pin;

wherein said skid splitter is usable to lift said log and split said log into six pieces;

wherein said host drive-machine comprises a hydraulic fluid reservoir and a pump to activate said hydraulic cylinder;

wherein said skid splitter is horizontally oriented outwardly from said host drive-machine;

wherein said skid splitter is mounted from said host drive-machine such that said hydraulic cylinder is located above said post allowing said splitting wedge assembly and said log push plate on said gussetted slider-tube to be normally-downwardly-facing so that said log push plate and said splitting wedge assembly are able to clamp one to each end of said log such that said log may be squeeze-held, lifted, six-way split and dropped into a receptacle;

wherein said splitting wedge assembly comprises a left-side jaw and said log push plate comprises a right-side jaw, said left-side jaw and said right-side jaw are movable in relation to each other enabling said skid splitter to pick up said log(s) from above and release six-way split said log into said receptacle from above;

wherein said hydraulic cylinder is connected to said host drive-machine via hydraulic hoses wherein said hydraulic hoses are in fluid communication with said hydraulic fluid reservoir such that said pump is able to circulate fluid to said hydraulic cylinder to open and close said right-side jaw and said left-side jaw, wherein said hydraulic hoses are located above said hydraulic cylinder such that said hydraulic hoses are located apart from said log to avoid being pinched; and wherein said post provides a mount for said splitting wedge assembly such that said log push plate assembly can be moved via said hydraulic cylinder, when actuated, said hydraulic cylinder pushing said log push plate and said gussetted slider-tube and said log push plate assembly towards said splitting wedge assembly such that said log located therebetween is able to be control-fractured.

15. The skid splitter of claim 14 wherein said step wedge is able to minimize force needed to split said log.

* * * * *